US005386638A

United States Patent [19]

Weber

[11] Patent Number: 5,386,638

[45] Date of Patent: Feb. 7, 1995

[54] PAPER PUNCH

[75] Inventor: Karl Weber, Stuttgart, Germany

[73] Assignee: Heinrich Meyer-Gotz, Stuttgart, Germany

[21] Appl. No.: 104,093

[22] PCT Filed: Jan. 10, 1992

[86] PCT No.: PCT/EP92/00037

§ 371 Date: Aug. 19, 1993

§ 102(e) Date: Aug. 19, 1993

[87] PCT Pub. No.: WO92/14589

PCT Pub. Date: Mar. 9, 1992

[30] Foreign Application Priority Data

Feb. 19, 1991 [DE] Germany ..... 9101864[U]

[51] Int. Cl.[6] ..... B26F 1/36

[52] U.S. Cl. ..... 30/358; 30/363; 83/167

[58] Field of Search ..... 30/363, 358, 360, 364, 30/359, 361, 364; 83/588, 167, 620

[56] References Cited

U.S. PATENT DOCUMENTS

| | | | |
|---|---|---|---|
| 803,727 | 11/1905 | Tengwall | 83/167 |
| 961,800 | 6/1910 | Rogers | 30/363 |
| 1,146,971 | 7/1915 | Stevens | 83/167 |
| 1,567,374 | 12/1925 | Keeni | 83/588 |
| 3,087,367 | 4/1963 | Semler | 83/588 |
| 4,166,404 | 9/1979 | Almog | 83/167 |

FOREIGN PATENT DOCUMENTS

| | | | |
|---|---|---|---|
| 1365485 | 5/1964 | France | 30/363 |
| 3534805 | 4/1987 | Germany . | |
| 9011500 | 11/1990 | Germany . | |
| 418299 | 2/1967 | Switzerland . | |
| 740305 | 11/1955 | United Kingdom . | |

*Primary Examiner*—Eugenia Jones
*Assistant Examiner*—Allan M. Schrock
*Attorney, Agent, or Firm*—Jones, Tullar & Cooper

[57] ABSTRACT

A paper punch having a pair of pivotably mounted top struts and a pair of pivotably mounted bottom struts, with the pair of top struts being pivotably mounted to the pair of bottom struts. As mounted, the pairs of struts can fold against each other. Associated with each adjacent top and bottom strut is a die which moves through guide openings when the struts are moved into their operative position away from each other. A spring is situated between each adjacent top and bottom strut for biasing each adjacent top and bottom strut away from each other as the pairs of struts are moved in a direction opposite to their folding direction. One of the pairs of struts define slits for the reception of a paper sheet to be punched.

14 Claims, 5 Drawing Sheets

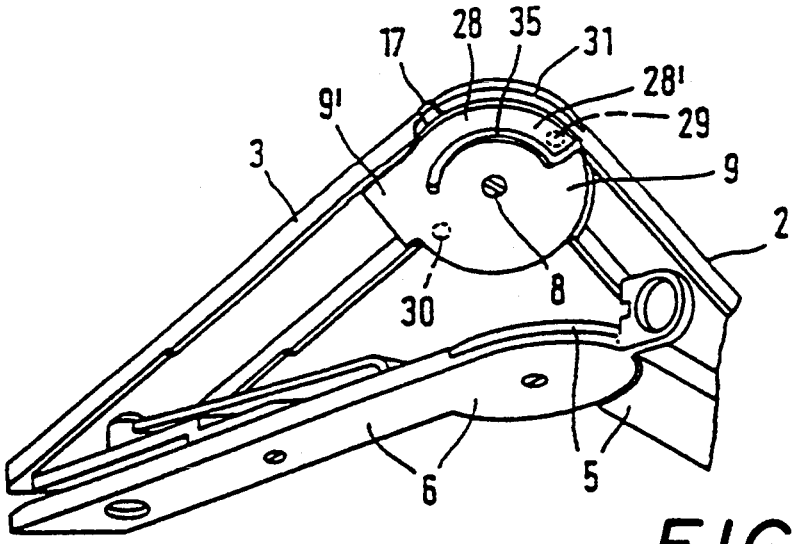
FIG. 7
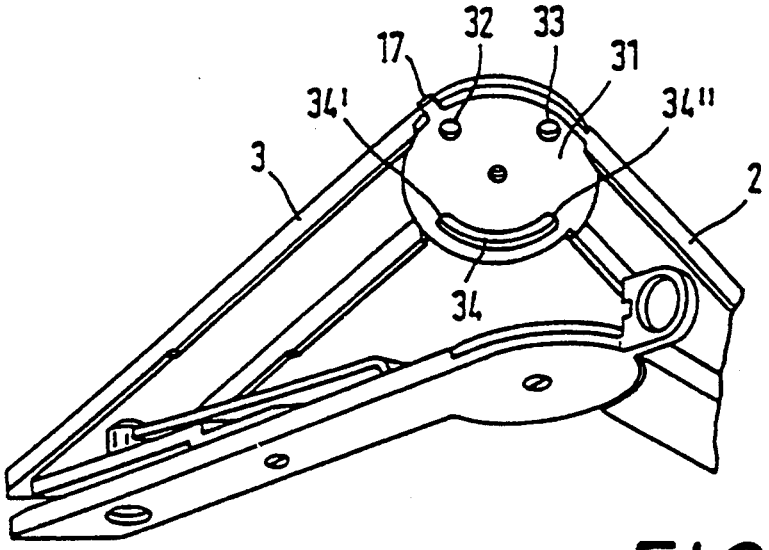
FIG. 8
FIG. 9
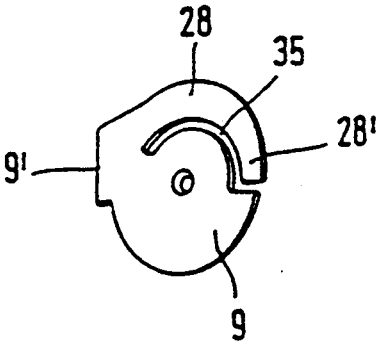
FIG. 10
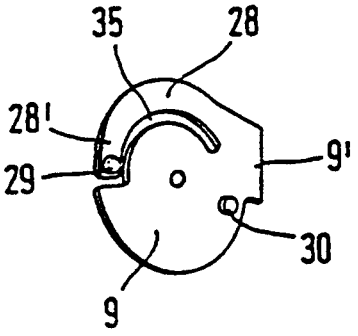

PAPER PUNCH

BACKGROUND OF THE INVENTION

The present invention relates to a paper punch with a bottom part having two slits for inserting a sheet to be provided with holes, the upper surface of which is respectively provided with a guide opening and the lower surface respectively with a die opening, and also having a top part hinged on the bottom part which, when pressed downward, presses the punch dies guided in the guide openings into the two die openings against the force of a spring and in the course of this makes holes in the sheet.

It is the object of the present invention to provide a paper punch which is foldable, i.e. which can easily be carried and in the pocket of pants, coats or shirts in the folded-together position.

SUMMARY OF THE INVENTION

A foldable paper punch of this type is distinguished in that the top part and the bottom part are each formed by two struts and that both struts of the bottom part and both struts of the top part can be folded against each other, that the outer ends of the struts of the top part are rotatably hinged on the outer ends of the struts of the bottom part, and that the hinge pins of these hinges are aligned with each other in a folded position of the top part and the bottom part intended for making the holes.

BRIEF DESCRIPTION OF THE DRAWINGS

Advantageous further embodiments of the invention are defined in the dependent claims. An exemplary embodiment of the invention and its advantageous further embodiments will be described in more detail below, making reference to the drawings. Shown are in:

FIG. 7 is an enlarged view of some details of the illustration of FIG. 6, particularly of the disk 9 provided on the strut 3;

FIG. 8 is an illustration as in FIG. 7, but after the disk (9) has been removed;

FIG. 9 shows the disk (9);

FIG. 10 shows the disk (9), but from the back;

DETAILED DESCRIPTION OF THE PREFERRED EMBODIMENT

Figure 1:
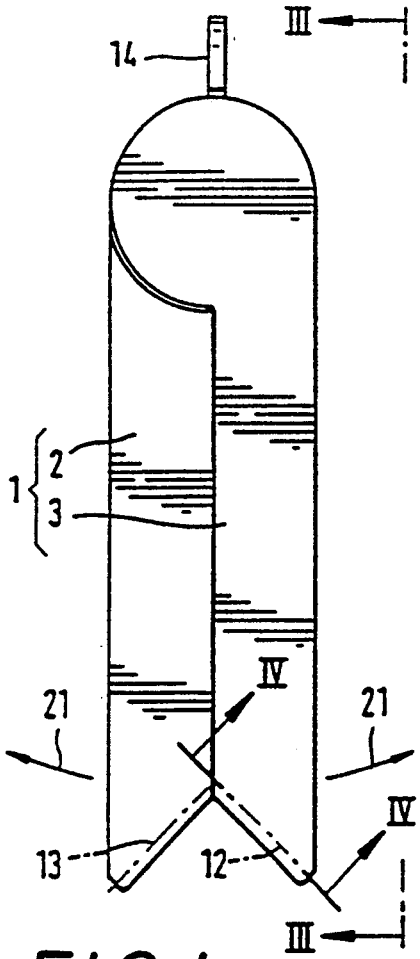
FIG. 1 a top view of a paper punch.
Figure 2:
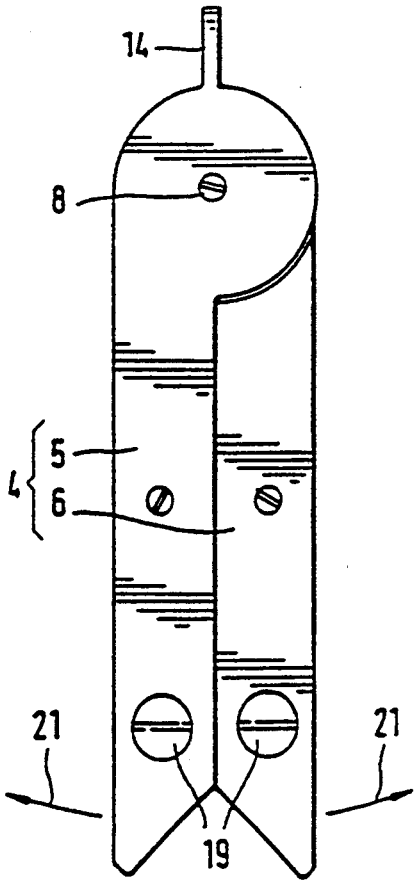
FIG. 2 a bottom view of the paper punch.
Figure 3:
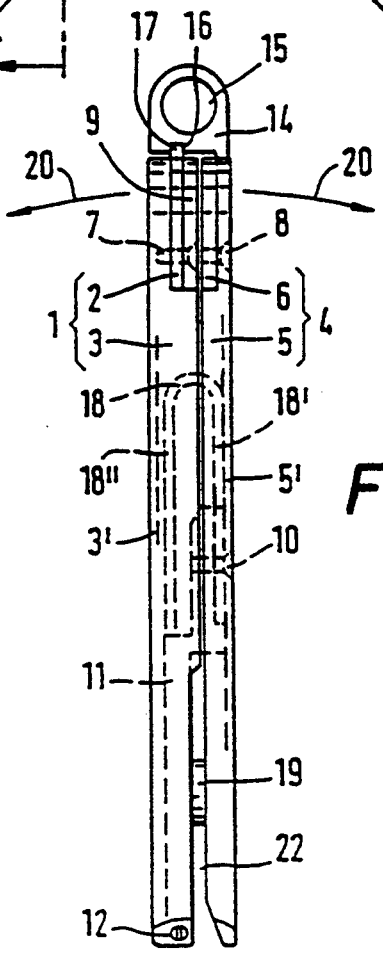
FIG. 3 a lateral view in the direction of arrows III—III in FIG. 1.

In FIGS. 1 to 3 the paper punch is shown in the folded-up state, in which it can be easily placed into a coat or pants pocket. In the top view (FIG. 1), the two struts 2 and 3 forming the top part 1 are visible; in the view from the bottom (FIG. 2), the two struts 5 and 6 forming the bottom part 4 are visible. The struts 2 and 3 are foldably connected with each other via a rotating connection formed by the screw 7 (FIG. 3). The struts 5 and 6 are foldably connected with each other via a rotating connection formed by the screw 8 (FIG. 2, FIG. 3). This rotatable connection permits a mutual turning of the struts 2, 3 or 5, 6 with respect to each other, but this only to an extent limited to an angle of 90° and in one plane; for this reason the statement is made hereinafter that the struts 2, 3 and 5, 6 can be "folded" against each other. As can be seen in FIG. 3, a further disk 9 is connected with the struts 2 and 3 at the place of the folding connection and is inserted into the strut 3 in such a way that it cannot twist in respect to it, and which is used to fix the struts 2 and 3 in relation to each other in the folded position shown in FIGS. 1 to 3 as well as in the opened position.

Figure 4:
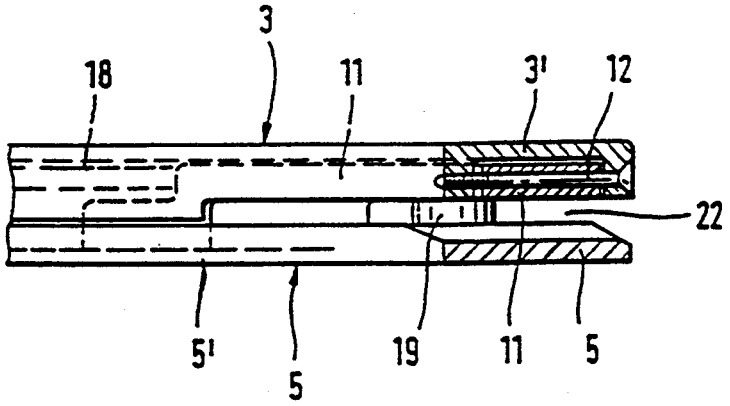
FIG. 4 a section taken along the line IV—IV in FIG. 1.

Arms 11, which are crimped in a step-shaped manner are disposed on the strut 5—and (in FIG. 3) behind it correspondingly on the strut 6—by means of screws 10. The slits 22 and 22' for inserting a sheet 23 to be punched result between the free ends of the arms 11 and the struts 5 or 6 (see also FIGS. 4, 5, 6). At the outer end of the arms 11 the struts 2 or 3 are then hinged. Thus, if it is hereinafter stated that the outer ends of the struts 2, 3 are hinged to the outer ends of the struts 5, 6, the arms 11 are then considered as components of the struts 5, 6. Hinging takes place by means of hinge pins 12, 13 which are screwed into the lateral parts of the U-shaped struts 2 or 3, as shown in FIG. 4.

As shown in FIG. 3, a strap 14, disposed crosswise to the plane of the struts, with an opening 15 is located on the top of the strut 5. This strap is fixed on the strut 5 or made of one piece with it. The strap 15 has a slit 16, into which a cam 17 extends in the folded-up position (FIGS. 1 to 4). The cam 17 is fixed on the strut 2. The strut 5, connected with the strap 14, is part of the bottom part 4. The strut 2 on which the cam 17 is fixed, is part of the top part 1. By fixing the cam 17 in this slit 16 or on its one side, the top part 1 is locked with respect to the bottom part 4 in such a way in the folded position (FIGS. 1 to 4) that the two cannot be pushed apart by the spring 18 acting between them.

For the sake of clarity, the spring 18 is shown hidden in FIG. 3. It is embodied to be U-shaped. One of its legs 18' is fixedly connected with the bottom part 5' (see FIG. 5) of the strut 5 which is U-shaped in cross section. The other leg 18" of the spring constitutes the free end and supports the punch die 19. The head part 24 of the latter is thus pressed against the bottom part 3' (see FIG. 4) of the strut 3, also U-shaped in cross section (see FIG. 4). These parts have not all been shown completely in FIG. 3, because otherwise FIG. 3 would be overly crowded. But it can be seen from FIGS. 4, 5 and 6.

Figure 5:
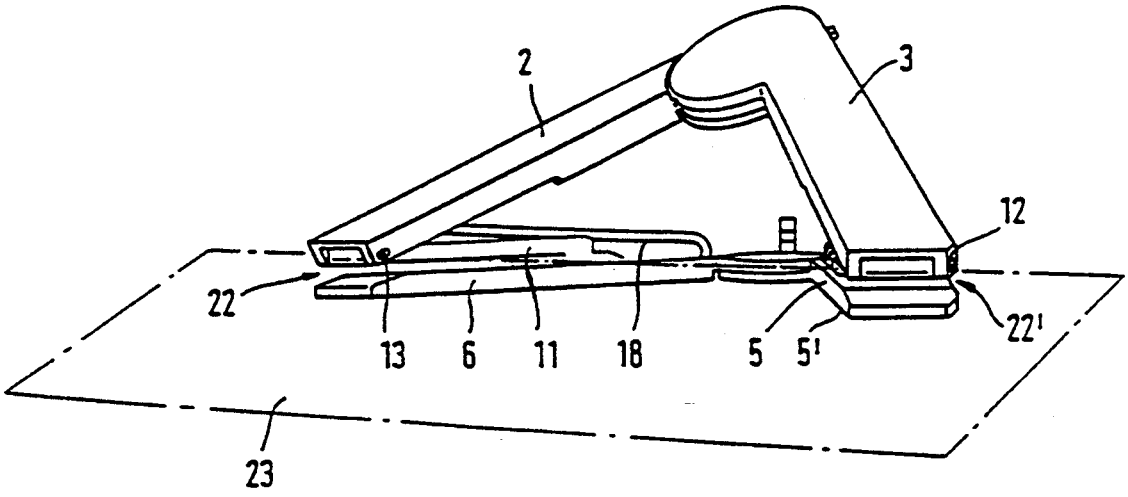
FIG. 5 shows the paper punch in the folded-open and working position.
Figure 6:
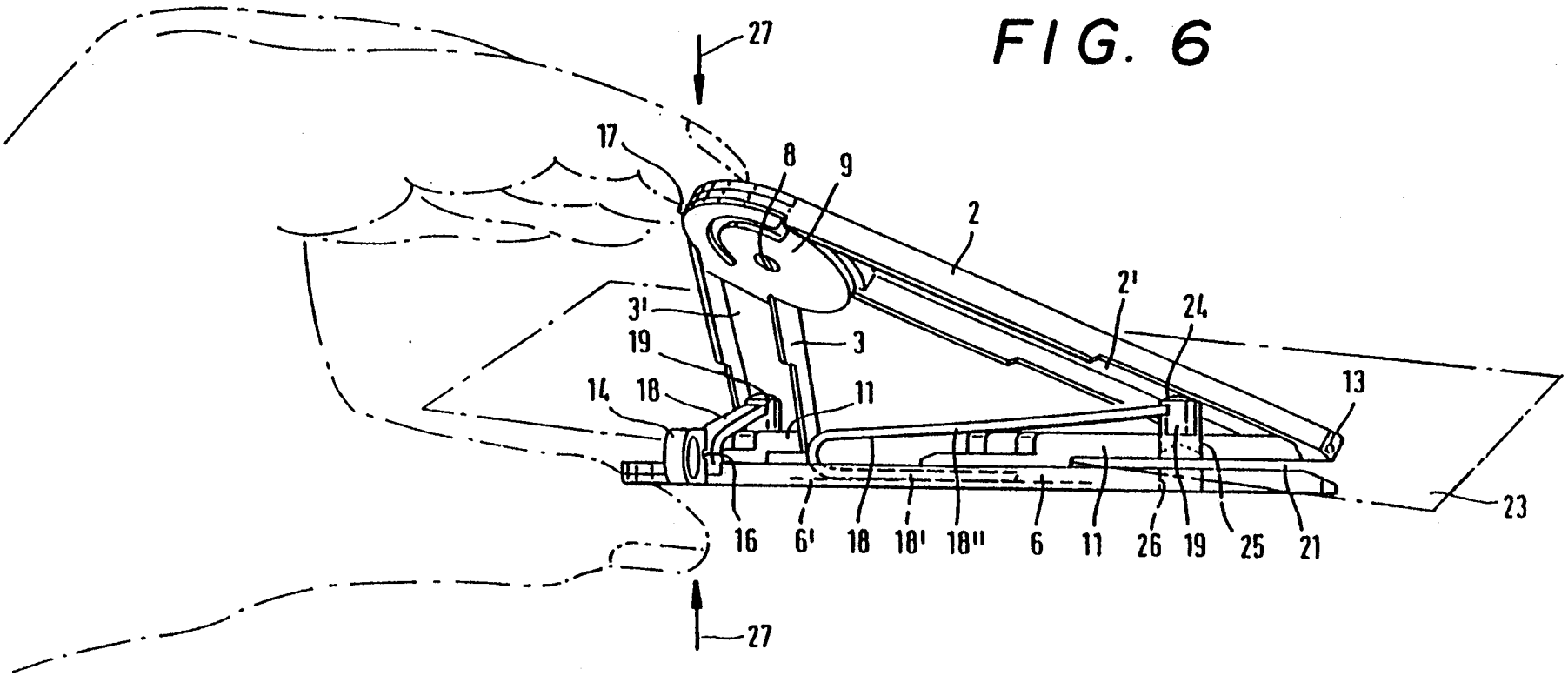
FIG. 6 a view of the paper punch in the same working position as in FIG. 5, but from the opposite side, i.e. from the back in FIG. 5.

If the paper punch is now folded open, i.e. the struts 2, 6 are folded away from the struts 3, 5 in the direction of the arrows 21 (FIGS. 1, 2), the described locking of the cam 17 in the slit 16 no longer exists. The spring 18 pushes the top part 1 away from the bottom part 4 in the direction of the arrows 20 in FIG. 3. The outer ends of the struts 2, 3 now can turn or fold open with respect to the outer ends 5, 6 (FIGS. 5, 6). However, a further requirement for this is that this unfolding takes place far enough so that the hinge pins 12, 13 are aligned in respect to each other. But this is the case if the paper punch is folded open in the direction of the arrows 21 in FIGS. 1 and 2 in such a way that the struts 2, 3 and 5, 6 respectively form an angle of 90° with each other. But if this position is not achieved, i.e. if the hinge pins 12, 13 are not aligned with each other, the paper punch cannot be "folded open" in this way.

The embodiment of the spring 18 can best be seen in FIG. 6. As already mentioned, it is fastened, for example soldered or screwed, with its leg 18' on the bottom part 5' of the leg 5.

As shown by dashed lines on the right side of FIG. 6, the arm 11 has a guide opening 25 which is disposed in such a way that the punch die 19 is guided in it when it is pressed down. The other end of the strut 6 has a die opening 26 aligned with the guide opening 25, into which the punch die 19 is pressed in the course of its downward movement in such a way that in a known manner its cutting edges make a hole into the sheet 23 inserted into the slit 21. The downward movement of the punch die 19 is caused in that—with the sheet 23 inserted—the paper punch is grasped between thumb and index finger at the place where the struts 2, 3 of the top part 1, and 5, 6 of the bottom part 4 are hinged so they can rotate with respect to each other, i.e. to the left in FIG. 6, and compressed in the direction of the arrows 27. In this case the bottom part 2' of the strut 2, which is U-shaped in cross section, pushes against the head surface 24 of the punch die 19. By means of this the springs 18 are compressed and in turn by means of that the punch dies 19 are moved downward.

FIG. 7 shows, in an enlarged view, the folding connection of the struts 2 and 3 with the disk 9. As already mentioned, the disk 9 is connected by means of the screw 8 with the struts 2, 3 at their fulcrum. It has a tab 9' which is inserted between the two legs of the strut 3, which is U-shaped in cross section, in such a way that the disk 9 cannot turn in respect to the strut 3. Furthermore, as can be seen from FIGS. 6 and 10, the disk 9 has a slit 35 which extends over a quarter of a circle around the screw 8. One end of the slit terminates flush inside the disk 9; the other end opens radially outward. A leaf spring 28 in the shape of a quarter circle segment is created in this way, the free front end 28' of which can be elastic in relation to the strut 2. If this situation is simplified, a leaf spring 28 is fixed on the strut 3—by means of the tab 9' and the screw 8—, the free end 28' of which presses against the strut 2.

FIG. 9 shows the disk 9 from the same side as FIG. 7, but as a single part. FIG. 10 shows the disk 9 from the back. It can be seen from this that a small pin—or nipple-shaped protrusion 29 is disposed at the front end 28' of the leaf spring 28—facing the widened area 31 of the strut 2.

FIG. 8 shows the same view as FIG. 7, but with the difference that the disk 9 has been removed. From this it can be seen that the circularly widened area 31 of the strut 2, which in FIG. 7 was hidden behind the disk 9, has been provided with two bores 32, 33; furthermore, the circular area 31 is provided with a quarter circle groove 34. Now if the strut 2 lies over the strut 3 and thus also the disk 9 fixed on the strut 3 over the strut 2, the protrusion 29 extends into the opening 32 in the folded-up, parallel position of the struts 2, 3 with respect to each other (as in FIGS. 1 to 4). In the opened (working) position of the paper punch—as in FIGS. 5 to 8—the protrusion 29 is pressed into the bore 33. The transition is provided in that by means of a slight application of force the leaf spring 28 is lifted off the area 21 of the strut 2 sufficiently far that the protrusion 29 is freed and can pivot with respect to the strut 2.

The movement of the struts 2, 3 with respect to each other is limited in that in the one position the protrusion 30 (see FIG. 10) rests against the left end 34' of the groove 34. In the other position, i.e. the folded position of the struts 2, 3, the protrusion 30 rests against the right end 34' of the groove 34. Thus it is also assured in this manner that the desired unfolding or spreading of the two struts of the parts 1,4—namely by 90° —is securely maintained. This must correspond to a defined standard value.

Figure 13:
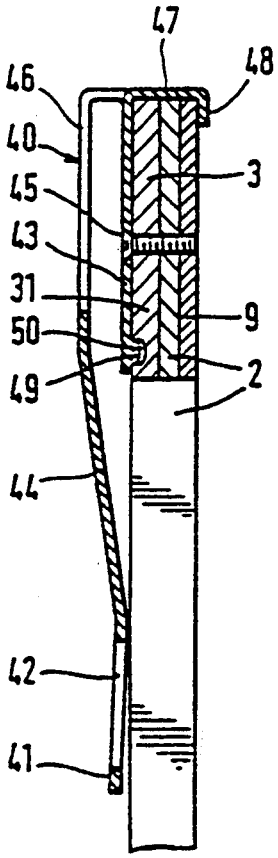
FIG. 13 shows a section taken along the line XIII—XIII in FIG. 12.
Figure 12:
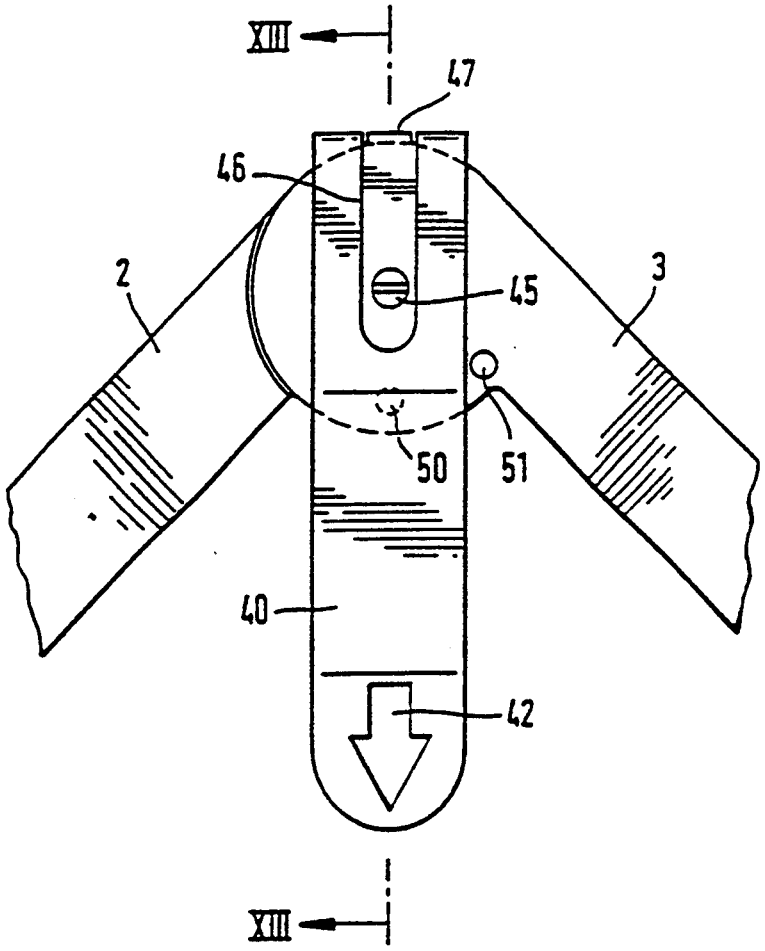
FIG. 12 shows the clamp (40) after having been seated on the connecting point of the struts 2, 3 and fastened on them.
Figure 11:
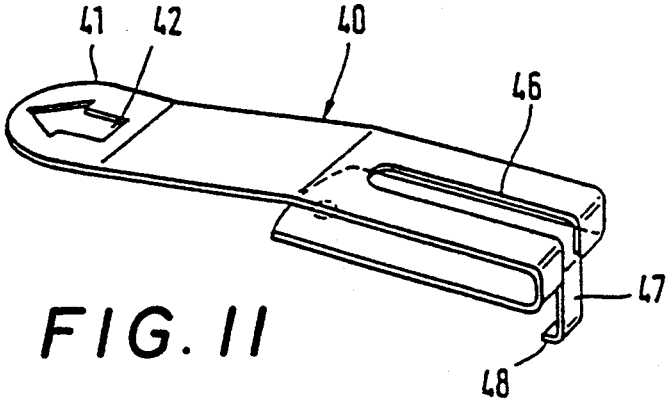
FIG. 11 shows a clamp (40)

FIGS. 11 to 13 show a clamp 40 and its attachment on the top of the foldable paper punch in accordance with FIGS. 1 to 10. The clamp 40 has been provided in place of the rotary connection of the struts 2, 3. With the aid of the freely extending end 41, which resiliently presses against the struts 2, 3 located at the front, it is possible to clip the paper punch to the breast pocket of a shirt or the inside pocket of a coat. Thus this clamp 40 constitutes a clip such as is also used with pencils, ballpoint pens, etc., but which is specially adapted to the particular purpose of the present case. In addition, the clip has an arrow-shaped opening 42. If care is taken that the clamp 40 is in the position of the median line of the angle between the struts 2, 3 in their unfolded and spread open position, the arrow-shaped opening 42 is used to position a center line, which is printed or marked by a fold, of a sheet 23 in the paper punch in such a way that the two holes are made symmetrically in respect to the center line.

As best seen in the cross-sectional view of FIG. 13, the clamp 40 is bent in a U-shape, wherein the lower leg 43 is embodied to be shorter than the upper leg 44. The clamp 40 is screwed together with the struts 2, 3 and the disk 8 by means of the screw 44, which is provided in place of the screw 8 in FIGS. 1 to 10. A small tab 47 is cut out of a recess 46 in the upper leg 44 and is bent downward in the manner visible from FIGS. 11 and 13 and provided with a small crown 48, with which it extends over the two areas of the struts 2, 3 and the disk 9. At the same time the lower end in FIG. 13 of the lower leg 43 has a protrusion 49 which snaps into an opening 50 in the area 31 of the strut 2 in the working position of the paper punch (FIGS. 5 to 8). If the paper punch is folded up (FIGS. 1 to 4), it is also possible to turn the clamp 40 manually in such a way that now the protrusion 49 snaps into the opening 51 and in this way the clamp 40 is aligned parallel to the legs 2, 3.

I claim:

1. A paper punch, comprising:

a pair of pivotably connected top struts;

a pair of pivotably connected bottom struts, said top struts being so that each top strut is adjacent a respective bottom strut pivotably connected to said bottom struts, and each pair of struts being movable to cause the struts in each pair of struts to fold against each other;

a die operatively disposed between each adjacent top and bottom strut; and a spring situated between each adjacent top and bottom strut for biasing each of said adjacent top and bottom struts away from each other as the pairs of struts are moved away from each other wherein each of said pairs of struts defining spaced apart guide openings and having aligned spaced apart die openings, each receiving a respective one of said dies, and said dies moving through their respective guide and die openings when said pairs of struts are moved toward each other and in a direction opposing the bias of each spring.

2. The paper punch as defined in claim 1, further wherein said guide openings comprise an arm mounted to a respective strut of said pair of bottom struts, each arm defining a step-shaped end and a linear end.

3. The paper punch as defined in claim 2, further wherein said top struts are pivotably mounted to the linear end of a respective arm.

4. The paper punch as defined in claim 1, further wherein each spring is fastened at one end to a strut of said pair of bottom struts and with its other end engages a strut of said pair of top struts.

5. The paper punch as defined in claim 4, further wherein a die is fastened on said other end of each spring, each die being pressed against a respective strut of said pair of top struts.

6. The paper punch as defined in claim 1, further comprising:

a cam situated on one of said pairs of struts; and a stop situated on the other of said pairs of struts, said cam and stop being engaged when said pairs of struts are folded to prevent unfolding thereof.

7. The paper punch as defined in claim 1, further comprising:

a leaf spring fixed on one strut of said pair of top struts, said leaf spring having a resilient free end defining a protrusion, further wherein the other strut of said pair of top struts includes two bores, and said protrusion respectively engages one of said two bores when said pairs of struts are folded and unfolded.

8. The paper punch as defined in claim 7, further comprising:

a disk including a tab for fixing said disk to said one strut of said pair of top struts, further wherein said disk includes a slit which forms said leaf spring.

9. The paper punch as defined in claim 8, further wherein said slit forming said leaf spring extends a quarter circle, and one end of said quarter circle is open in the radial direction toward the outer circumference of said disk.

10. The paper punch as defined in claim 7, further comprising:

a further protrusion disposed on one strut of said pair of top struts; and a groove formed on the other strut of said pair of top struts, and wherein said further protrusion is guided by said groove, and the groove extent limits the movement of the struts of said pair of top struts.

11. The paper punch as defined in claim 7, further comprising:

a disk fixed on one strut of said pair of top struts;

a further protrusion disposed on said disk; and a groove formed on the other strut of said pair of top struts, and wherein said further protrusion is guided by said groove, and the groove extent limits the movement of the struts of said pair of top struts.

12. The paper punch as defined in claim 1 including a clamp, said clamp including means to attach said clamp to the pivotal mounting of said pair of top struts and said pair of bottom struts.

13. The paper punch as defined in claim 12, wherein said clamp has two legs defining a U-shaped portion of said clamp, one of said legs including a protrusion, wherein the pivotal mounting of said struts includes an opening, and wherein said protrusion releasably engages said opening to thereby fix the position of said clamp relative to said punch.

14. The paper punch as defined in claim 12, wherein said clamp has two legs defining a U-shaped portion of said clamp and a tab with a crown formed from one of said legs, said tab and crown serving to connect said clamp to said struts.

* * * * *

UNITED STATES PATENT AND TRADEMARK OFFICE

CERTIFICATE OF CORRECTION

PATENT NO. : 5,386,638

DATED : February 7, 1995

INVENTOR(S) : Karl Weber

It is certified that error appears in the above-indentified patent and that said Letters Patent is hereby corrected as shown below:

On the cover page of the patent, under [73] Assignee: "Heinrich Meyer-Götz, Stuttgart, Germany" should read --Heinrich Meyer-Götz, Stuttgart, Germany and Karl Weber, Stuttgart, Germany, part interest--.

Signed and Sealed this

Second Day of July, 1996

*Attest:*

*Attesting Officer*

BRUCE LEHMAN

*Commissioner of Patents and Trademarks*